US005451833A

United States Patent [19]

Tong

[11] Patent Number: 5,451,833

[45] Date of Patent: Sep. 19, 1995

[54] SHADOW MASK DAMPING FOR COLOR CRT

[75] Inventor: Hua-Sou Tong, Arlington Heights, Ill.

[73] Assignee: Chunghwa Picture Tubes, Ltd., Taoyuan, Taiwan

[21] Appl. No.: 141,999

[22] Filed: Oct. 28, 1993

[51] Int. Cl.[6] ..... H01J 29/80

[52] U.S. Cl. ..... 313/402; 313/269

[58] Field of Search ..... 313/402, 403, 404, 269; 445/37, 47

[56] References Cited

U.S. PATENT DOCUMENTS

| | | | |
|---|---|---|---|
| 3,973,965 | 8/1976 | Suzuki et al. | 445/47 |
| 4,442,376 | 4/1984 | Van Der Waal et al. | 313/408 |
| 4,629,932 | 12/1986 | Tokita | 313/402 |
| 4,631,439 | 12/1986 | D'Amato et al. | 313/402 |
| 4,665,338 | 5/1987 | Inaba et al. | 313/402 |
| 4,716,333 | 12/1987 | Kiyoshi et al. | 313/402 |
| 4,734,615 | 3/1988 | Koike et al. | 313/402 |
| 5,028,836 | 7/1991 | Hirasawa | 313/402 |
| 5,167,557 | 12/1992 | Teramoto et al. | 445/37 |
| 5,170,093 | 12/1992 | Yamamoto et al. | 313/403 |

OTHER PUBLICATIONS

*High-definition television display-a CRT approach,* Hua-Sou Tong, pp. 1757-1761, Optical Engineering, vol. 32 No. 8, Aug., 1993.

*Primary Examiner*—Edward L. Coles, Sr.
*Assistant Examiner*—Jerome Grant, II
*Attorney, Agent, or Firm*—Emrich & Dithmar

[57] ABSTRACT

A damping arrangement for use with a shadow mask in a color cathode ray tube (CRT) absorbs vibrations of the shadow mask, particularly at low frequencies, to maintain registration of the shadow mask apertures with phosphor deposits on the inner surface of the CRT's faceplate for high video image color purity. A damping material having a higher modulus of elasticity (Young's modulus) than that of the shadow mask is applied to one or both surfaces of the shadow mask either over the entire surface or in spaced bands extending the length or width of the mask. The damping coating may be applied either by spraying or by vacuum deposition and may be comprised of virtually any material having a higher modulus of elasticity than that of the shadow mask such as a glass-based frit or a heavy metal such as tungsten or molybdenum.

11 Claims, 1 Drawing Sheet

FIG. 1
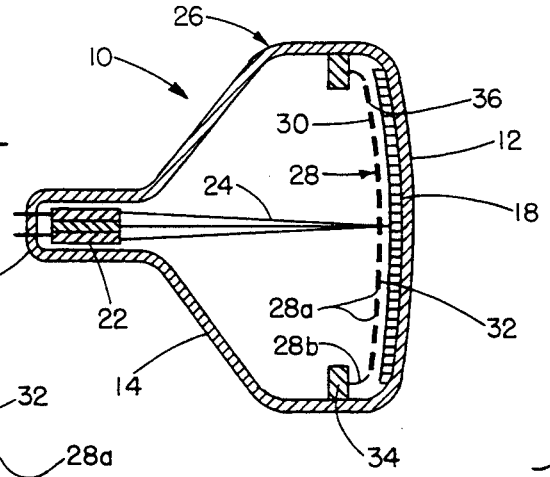
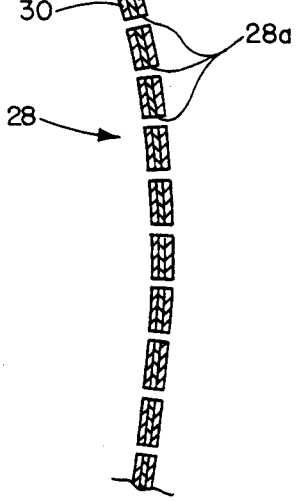
FIG. 1a
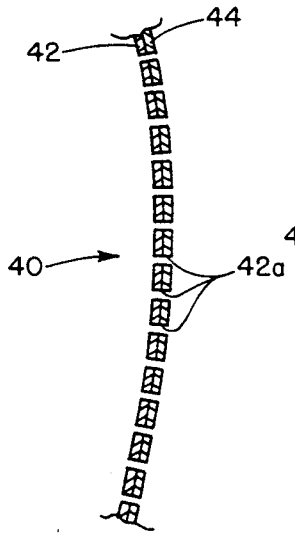
FIG. 1b
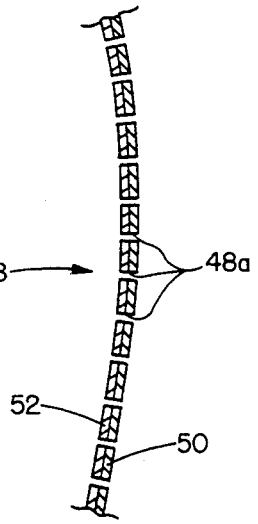
FIG. 1c
FIG. 2
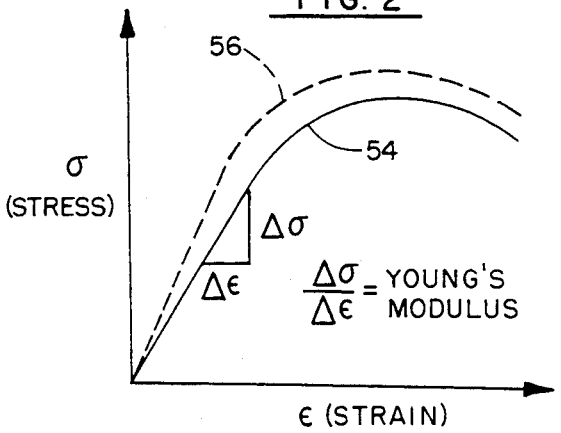
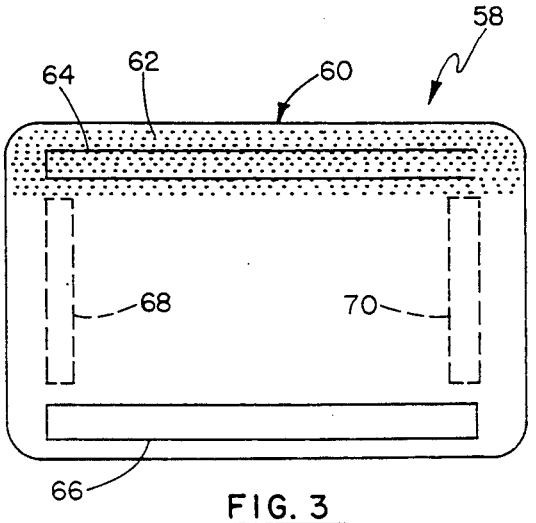
FIG. 3

SHADOW MASK DAMPING FOR COLOR CRT

FIELD OF THE INVENTION

This invention relates generally to color cathode ray tubes (CRTs) having a shadow mask for controlling electron beam incidence upon phosphor elements on the CRT's faceplate and is particularly directed to a damping arrangement for reducing shadow mask vibration and maintaining the shadow mask's electron beam passing apertures in registration with the phosphor elements for improved video image color purity.

BACKGROUND OF THE INVENTION

The shadow mask concept currently used in color CRTs dates back to 1949. While the mask pattern has taken on various forms over the years such as dots, strips and slots, the basic theory of operation remains unchanged: three separately modulated electron beams converged and scanned both horizontally and vertically across a cathodoluminescent screen by means of a deflection yoke mounted on the CRT neck are used. Display panel screening is made photolithographically using a mask as the stencil. Shadow mask color CRTs have dominated the consumer market for more than four decades because of their far superior brightness, contrast and mature technologies.

The shadow mask is used in combination with a target or screen consisting of a regular pattern of photodeposited triads of red, blue and green light-emitting phosphors on the CRT's faceplate. The shadow mask is foraminous and is disposed a predetermined distance from the target, and by virtue of its pattern of beam passing apertures, effectively shadows all but selected ones of the individual light-emitting phosphors from its corresponding electron beam-emitting source located in the neck of the CRT. Precise registration between the mask's beam passing apertures and the faceplate's light-emitting phosphor deposits is essential for a high degree of video image color purity. Misregistration of the mask apertures with the phosphor deposits is sometimes caused by mask "doming" caused by nonuniform electron beam heating and expansion of the mask. The prior art includes various proposed approaches for correcting for shadow mask doming as disclosed, for example, in U.S. Pat. Nos. 4,629,932; 4,656,388; 4,665,338; 4,716,333; 4,734,615 and 5,028,836. Maintaining precise registration between the shadow mask apertures and the faceplate phosphor deposits is even more critical, and more difficult to maintain, in high definition television (HDTV) receivers which incorporate a flat shadow mask maintained in a stretched condition under high tension.

Misregistration of the shadow mask apertures with the faceplate phosphor deposits may also arise from vibration of the shadow mask. Shadow mask vibration is typically caused by extraneous factors such as by impact with the faceplate or high intensity sound waves as produced by high quality audio signals in television receivers equipped with a stereo receiving capability. Shadow mask vibration becomes increasingly severe for shadow masks having reduced curvature and finer pitch (increased number of beam passing apertures per unit area) such as employed in high performance color monitors and high end, large display television receivers. Shadow mask damping is also critical because of the increasing use of materials having a low modulus of elasticity and high yield strength which are more subject to vibration, particularly at low frequencies, and particularly in the case of masks comprised of Invar. Even masks having a higher modulus of elasticity such as those comprised of aluminum killed (AK) steel exhibit vibration. Invar is comprised of an iron-nickel alloy having a small coefficient of thermo-expansion, while AK steel is steel to which a strong de-oxidizing agent (such as aluminum) has been added while in the molten state to minimize the reaction between oxygen and carbon during solidification. In addition, vibration of the shadow mask may cause a coating such as of graphite on the mask to separate and minute flakes to fall off. Flakes adhering to the shadow mask may cause blockage of the electron apertures, adversely affecting the characteristics of the video image on the phosphor screen. Loosened flakes adhering to the electron gun may cause sparks between the electrodes, limiting the capacity to withstand high voltages and also contributing to a reduction in video image quality.

The present invention addresses the aforementioned limitations of the prior art by providing shadow mask damping for a color CRT which restricts mask vibration for improved video image color purity.

OBJECTS AND SUMMARY OF THE INVENTION

Accordingly, it is an object of the present invention to reduce shadow mask vibration in a color CRT for improved video image color purity.

It is another object of the present invention to compensate for low modulus of elasticity in a color CRT shadow mask, such as a shadow mask comprised of Invar, by increasing the modulus of elasticity of the shadow mask structure, thereby reducing shadow mask vibration, particularly at low frequencies, to maintain the shadow mask apertures in registration with phosphor deposits on the CRT's faceplate for improved video image color purity.

A further object of the present invention is to increase the modulus of elasticity of a metal shadow mask structure in a color CRT without degrading its color selection operation on the electron beams passing through the shadow mask particularly following initial CRT turn-on.

These objects of the present invention are achieved and the disadvantages of the prior art are eliminated by a shadow mask structure for use in a color cathode ray tube (CRT) having a faceplate with a plurality of spaced light-emitting phosphor deposits on an inner surface thereof, wherein the shadow mask structure limits incidence of a plurality of electron beams on selected ones of the phosphor deposits, the shadow mask structure comprising: a thin metallic sheet-like member having first and second opposed surfaces and a plurality of spaced electron beam passing apertures and a modulus of elasticity of $E_1$; and a rigid coating disposed on at least one of the surfaces of the sheet-like member about the apertures therein having a modulus of elasticity of $E_2$, where $E_2 > E_1$, for damping vibrations of the sheet-like member.

BRIEF DESCRIPTION OF THE DRAWINGS

The appended claims set forth those novel features which characterize the invention. However, the invention itself, as well as further objects and advantages thereof, will best be understood by reference to the following detailed description of a preferred embodiment taken in conjunction with the accompanying drawings, where like reference characters identify like elements throughout the various figures, in which:

FIG. 1 is a sectional view of a color CRT incorporating a shadow mask damping arrangement in accordance with the present invention;

FIGS. 1*a*, 1*b* and 1*c* are partial sectional views of various embodiments of a shadow mask structure incorporating a vibration damping arrangement in accordance with the principles of the present invention;

FIG. 2 is a graphic representation of the modulus of elasticity (Young's modulus) of the shadow mask structure of the present invention compared with the modulus of elasticity of prior art shadow masks; and FIG. 3 is a plan view of a shadow mask incorporating a vibration damping arrangement in accordance with another embodiment of the present invention.

DETAILED DESCRIPTION OF THE PREFERRED EMBODIMENTS

Referring to FIG. 1, there is shown a sectional view of a color CRT 10 incorporating a shadow mask damping arrangement in accordance with the principles of the present invention. CRT 10 includes a sealed glass envelope 26 having a forward faceplate, or display screen, 12, an aft neck portion 16, and an intermediate funnel portion 14. Disposed on the inner surface of glass faceplate 12 is a phosphor screen 18 which includes a plurality of discrete phosphor deposits, or elements, which emit light when an electron beam is incident thereon to produce a video image on the faceplate 12. Disposed in the neck portion 16 of the CRT's glass envelope 26 are a plurality of electron guns 22 typically arranged in an inline array for directing a plurality of electron beams 24 onto phosphor screen 18. The electron beams 24 are deflected vertically and horizontally in unison across the phosphor screen 18 by a magnetic deflection yoke which is not shown in the figure for simplicity. Disposed in a spaced manner from phosphor screen 18 is a shadow mask assembly 28 including a plurality of spaced electron beam passing apertures 28*a* and a skirt portion 28*b* around the periphery thereof. The shadow mask skirt portion 28*b* is securely attached to a shadow mask mounting fixture 34 around the periphery of the shadow mask. The shadow mask mounting fixture 34 is attached to an inner surface of the CRT's glass envelope 26 and may include conventional attachment and positioning structures such as a mask attachment frame and a mounting spring which also are not shown in the figure for simplicity. The shadow mask mounting fixture 34 may be attached to the inner surface of the CRT's glass envelope 26 and the shadow mask assembly 28 may be attached to the mounting fixture by conventional means such as weldments or a glass-based frit.

In accordance with the present invention and as shown in greater detail in the partial sectional view of FIG. 1*a*, the shadow mask assembly 28 includes an inner damping coating, or layer, 30, an outer damping coating 32, and a foil shadow mask 36 disposed intermediate the inner and outer coatings. Foil shadow mask 36 may be conventional in design and composition and may be comprised of a material such as Invar or AK (aluminum-killed) steel. The inner and outer damping coatings 30, 32 are comprised of a material having a higher modulus of elasticity than that of the foil shadow mask 36. In the case of Invar, the foil shadow mask 36 has a relatively low modulus of elasticity and a high yield strength. As a result, an Invar foil shadow mask is very sensitive to vibration particularly when installed in a CRT having a flat, or relatively flat, faceplate and a large number of beam passing apertures per unit area (fine pitch). In this case, damping of the shadow mask is essential to maintain the shadow mask apertures 28*a* in registration, or alignment, with phosphor deposits, or elements, in the phosphor screen 18. The inner and outer damping coatings 30, 32 are comprised of a material having a higher modulus of elasticity than that of the foil shadow mask 36 and in a preferred embodiment are comprised of either a glass-based frit or a heavy metal such as tungsten or molybdenum. The inner and outer damping coatings 30, 32 may be applied to the foil shadow mask 36 by either spraying with a nozzle or by vacuum deposition. In that vibration is a surface phenomenon, the inner and outer damping coatings 30, 32 absorb vibration of the foil shadow mask 36, particularly at low frequencies. By employing small particles in the inner and outer damping coatings 30, 32, the apertures 28*a* within the foil shadow mask 36 remain open after the coatings are applied. As shown in the embodiment of FIG. 1, the inner and outer damping coatings 30, 32 are applied over the entire opposed surfaces of the foil shadow mask 36. To avoid blocking the masks's beam passing apertures 28*a*, particle sizes of up to approximately 1 micron may be used in the damping coating.

Referring to FIG. 1*b*, there is shown a partial sectional view of another embodiment of a shadow mask assembly 40 in accordance with the present invention. In the embodiment shown in FIG. 1*b*, a damping coating 44 is applied only to the outer surface of the foil shadow mask 42 as previously described such as by spraying or vacuum deposition. Again, by using small particles within the outer damping coating 44, the apertures 42*a* in the foil shadow mask 42 remain open to permit electron beam transit.

Referring to FIG. 1*c*, there is shown yet another embodiment of a shadow mask assembly 48 in accordance with the present invention. In the embodiment shown in FIG. 1*c*, only an inner damping coating 52 is applied to the inner surface of a foil shadow mask 50. In the respective embodiments shown in FIGS. 1*a*, 1*b* and 1*c*, the outer and inner damping coatings increase the modulus of elasticity of the shadow mask assembly for damping vibration of the foil shadow mask.

Referring to FIG. 2, there is graphically shown the change in stress with strain for a conventional shadow mask material as compared with a shadow mask assembly in accordance with the present invention. The slope of the linear portion of the first curve 54 shown in FIG. 2 is the modulus of elasticity, or Young's modulus, for a prior art shadow mask. Prior art shadow masks of Invar have a modulus of elasticity of $21\times10^6$ psi (pounds per square inch), while AK shadow masks have a modulus of elasticity of $31\times10^6$ psi. It is highly desirable to increase the modulus of elasticity or the slope of the curve. Shown in dotted-line form as curve 56 in FIG. 2 is the improved modulus of elasticity of a shadow mask assembly incorporating the damping coating, or coatings, of the present invention. The coating, or coatings, on the foil shadow mask absorb and dampen vibrations of the foil shadow mask while increasing the modulus of elasticity of the entire shadow mask assembly.

Referring to FIG. 3, there is shown an elevation view of another embodiment of a shadow mask assembly 58 in accordance with the principles of the present invention. The shadow mask assembly 58 includes a foil shadow mask 60 having a large number of spaced apertures 62 over its entire surface, where only the upper portion of the foil shadow mask 60 is shown with the beam passing apertures for simplicity. The shadow mask assembly 58 includes first upper and second lower damping bands, or strips, 64 and 66. The upper and lower damping bands 64, 66 may be disposed on one or both surfaces of the foil shadow mask 60 as previously described. Similarly, the upper and lower damping bands 64, 66 are applied to the foil shadow mask 60 in a manner which maintains the foil apertures 62 therein in an open condition for allowing transit of the electron beams. The upper and lower damping bands 64, 66 extend substantially the entire width of the foil shadow mask 60 and may be comprised of a glass-based frit or a heavy metal and are applied by spraying or vacuum deposition as in the previously described embodiments.

FIG. 3 also shows in dotted-line form third and fourth side damping bands 68 and 70 which may be used in combination with or as a replacement for the above-described first and second upper and lower damping bands 64 and 66. The third and fourth side bands 68, 70 are disposed adjacent respective lateral edges of the foil shadow mask 60 and are arranged generally parallel. The third and fourth side bands 68, 70 may be of the same composition and may be applied in the same manner to the foil shadow mask 60 as the previously described first upper and second lower damping bands 64 and 66. In both embodiments shown in FIG. 3, the parallel, spaced bands dampen vibrations of the foil shadow mask 60 to maintain its foil apertures 62 in registration with the phosphor elements in the phosphor screen which is not shown in the figure for simplicity. In one embodiment, the aforementioned bands are ½ inch in width and are spaced approximately 1 inch from an adjacent edge of the shadow mask 60.

There has thus been shown a shadow mask damping arrangement which includes a damping coating applied to one or both surfaces of an apertured shadow mask for use in a color CRT which dampens vibration of the shadow mask to maintain its foil apertures in registration with phosphor elements on the CRT's faceplate. The damping coating may be applied by spraying or vacuum deposition to the entire outer or inner surface of the foil shadow mask, or to both surfaces, in a manner which maintains the mask apertures open to permit transit of the electron beams. In another embodiment, the damping coating is applied in the form of a plurality of spaced bands, or strips, extending substantially either the entire width or height of the shadow mask. The damping coating is comprised of a material having a higher modulus of elasticity than the foil shadow mask such as a glass-based frit or a heavy metal such as tungsten or molybdenum.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

I claim:

1. For use in a color cathode ray tube (CRT) having a faceplate with a plurality of spaced light-emitting phosphor deposits on an inner surface thereof, a shadow mask structure for limiting incidence of a plurality of electron beams on selected ones of said phosphor deposits, said shadow mask structure comprising:

a thin metallic sheet-like member having first and second opposed surfaces and a plurality of spaced electron beam passing apertures and a modulus of elasticity of $E_1$; and a rigid coating disposed on at least one of the surfaces of said sheet-like member about the apertures therein having a modulus of elasticity of $E_2$, where $E_2 > E_1$, for damping vibrations of said sheet-like member, wherein said rigid coating is comprised of a glass-based frit or a heavy metal.

2. The shadow mask structure of claim 1 wherein said coating is disposed substantially over the entire surface of said sheet-like member.

3. The shadow mask structure of claim 1 wherein said coating is disposed substantially over the entire first and second opposed surfaces of said sheet-like member.

4. The shadow mask structure of claim 1 wherein said coating is disposed in a plurality of spaced, elongated, generally linear bands on the surface of said sheet-like member.

5. The shadow mask structure of claim 4 wherein said bands extend substantially the entire length of said sheet-like member.

6. The shadow mask structure of claim 4 wherein said bands extend substantially the entire width of said sheet-like member.

7. The shadow mask structure of claim 4 wherein said sheet-like member is comprised of Invar or aluminum-killed (AK) steel.

8. The shadow mask structure of claim 1 wherein said coating is disposed in a plurality of spaced, elongated, generally linear bands on the first and second opposed surfaces of said sheet-like member.

9. The shadow mask structure of claim 1 wherein said sheet-like member is comprised of Invar TM for aluminum-killed (AK) steel and wherein said rigid coating is comprised of a heavy metal such as tungsten or molybdenum.

10. The shadow mask structure of claim 1 wherein said rigid coating is comprised of particles up to 1 micron in size.

11. In a color cathode ray tube (CRT) having a glass faceplate with a phosphor screen on an inner surface thereof and an electron gun for directing a plurality of electron beams on said phosphor screen for forming a video image on said faceplate, said CRT including a shadow mask having a plurality of spaced apertures for permitting each of said electron beams to be incident upon selected phosphor deposits in said phosphor screen, said shadow mask having a low modulus of elasticity giving rise to vibration of said shadow mask, the improvement comprising:

an energy absorbing coating disposed on at least one of the surfaces of said shadow mask about the apertures therein, said energy absorbing coating comprised of a glass-based frit or a heavy metal and having a modulus of elasticity greater than that of said shadow mask for increasing the rigidity of said shadow mask and damping vibrations of said shadow mask.

* * * * *